United States Patent [19]

Lundstrom et al.

[11] 4,104,490

[45] Aug. 1, 1978

[54] CODING LOCK

[75] Inventors: Göran Lundström, Enskede; Karl Nolte, Huddinge, both of Sweden

[73] Assignee: Hugin Kassaregister AB, Stockholm, Sweden

[21] Appl. No.: 697,990

[22] Filed: Jun. 21, 1976

[30] Foreign Application Priority Data

Jun. 19, 1975 [SE] Sweden ..... 7507082

[51] Int. Cl.[2] ..... H01H 3/16

[52] U.S. Cl. ..... 200/44; 200/61.61

[58] Field of Search ..... 200/44, 61.61

[56] References Cited

U.S. PATENT DOCUMENTS

| | | | |
|---|---|---|---|
| 3,920,937 | 11/1975 | Hollins | 200/44 |
| 3,943,309 | 3/1976 | Kawamoto et al. | 200/44 X |

*Primary Examiner*—Leland A. Sebastian

*Attorney, Agent, or Firm*—Darby & Darby

[57] ABSTRACT

A lock system for cash registers or the like which does not require rotational movement of a key. The system has a key, with a pattern of lugs and gaps along an edge thereof, and a lock containing one row of fixed and one row of movable contacts are urged against the fixed contacts, in accordance with the pattern of lugs and gaps on the key, to produce the desired function.

9 Claims, 7 Drawing Figures

CODING LOCK

The present invention refers to a lock and contact system for cash registers or the like.

Hitherto these lock and contact systems have been based upon the use of cylinder locks and the consequently complicated key having vertically and longitudinally varying edge toothings for releasing the desired contact functions by the rotation of the key.

Besides the fact that this system requires two consecutive operations, i.e. first a translatory and then a rotational movement, it is obvious that the system is comparatively expensive especially on account of the high requirements on the tolerances of the lock and key.

These drawbacks are eliminated by the invention in that the key, formed—in a way known per se—as an edge punched flat elongated metal piece having lugs spaced by gaps, is adapted to, by its insertion, first reach a rest position and when further pushed-in, against a return force, to an end position produce contact functions determined by the edge toothings of the key. For cash registers and the like the invention provides the great advantage that the key after insertion in the lock can be used as a function button (i.e. an operation control button) which is easily replaceable and, for example, may be individual for each cash attendant. If the key is provided with a return spring it may be used for both a controlling and a starting function.

The invention will now be described in more detail with reference to the accompanying drawings.

Figure 1:
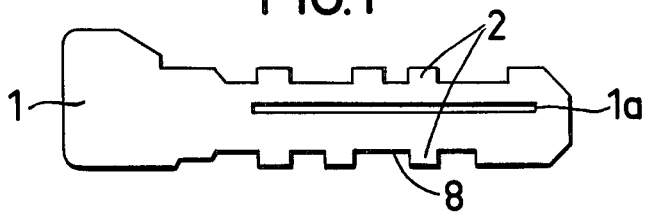
FIG. 1 shows a plan view of the key.

The key 1 in FIG. 1 is punched from a flat piece of metal and has on both side edges individually (according to a code) positioned lugs 2 of the same height and spaced by gaps 8, for selectively establishing contact functions desired. Further, the key is provided with a longitudinal groove 1*a* asymmetrically positioned, on one hand to avoid a false turning of the key when inserted, and on the other hand as a check that the inserted key actually is in its initial or rest position.

Figure 2:
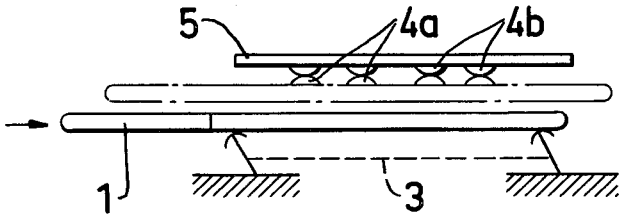
FIGS. 2–4 show schematic side views of respective three different embodiments of the invention.

FIG. 2 shows how the key 1 is inserted in the corresponding key hole in the lock and by means of a parallel mechanism 3 is swung up to a higher level, indicated by dash-and-dot lines. Thus, the edge lugs 2 of the key, distributed in accordance with the code pattern, lift the corresponding plate spring contact point 4*a*, via a suitable insulation, to engagement with contact points 4*b* on a printed circuit card 5, for closing the contact function desired, e.g. for gaining access to an individual memory for a respective cash attendant. While the contact points are shown to be closing for illustrative reasons, it is advantageous to use a contact breaking operation instead in order to avoid contact bouncing.

Figure 3:
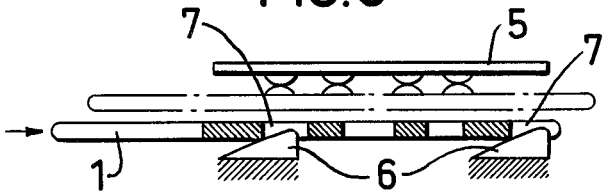

Also FIG. 3 shows a parallel raising of the key 1, this time by sliding on upwards inclined knobs or "hills" 6 engaging in punched-out openings 7 in the key. The manner of operation is quite analogue with that shown in FIG. 2.

Figure 4:
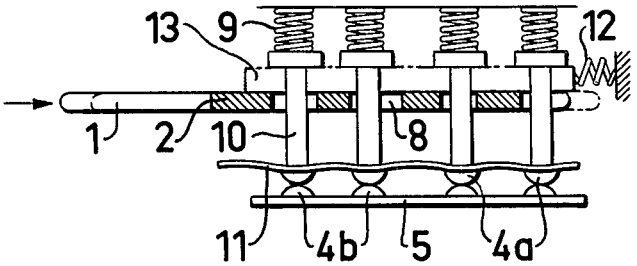
Figure 5:
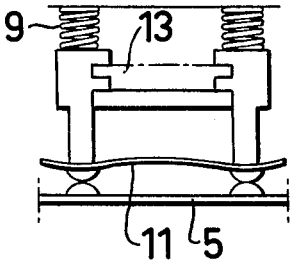
FIG. 5 shows an end view of the arrangement in FIG. 4.

In the two embodiments described above, the edge lugs 2 have been used for providing the contact function. FIGS. 4 and 5 show an embodiment where, on the contrary, the gaps 8 between the lugs 2 are used for effecting the contact movement. Thus, each gap 8 is sensed by a pin 10 under the action of a spring 9. The pins passing through the gaps are with their (in the figure) lower end urged against a resilient diaphragm 11, preferably of rubber, and press in the shown position contacts 4*a*, supported by the diaphragm or being separate, resilient contacts, against the contact points 4*b* on the printed circuit card 5.

By means of a compression spring 12—which (though not shown) is present also in the previous embodiments for returning the key—a returning member 13 presses (e.g. by inclined surfaces not shown) the pins 10 upwards to a neutral position, i.e. above the key level. When the key is inserted it forces the member 13 backwards which then permit the pins to pass through the gaps 8 and act on the contacts. A special advantage with the diaphragm arrangement is that it makes possible a hermetically sealed space between the movable contacts 4*a* and the fixed contacts 4*b* on the card 5 so that the contacts are protected from dust and other contaminations.

Figure 6:
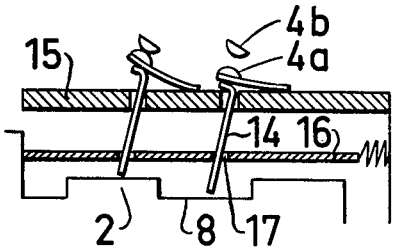
FIG. 6 shows a detail of a fourth embodiment.

In the embodiments described so far the contact movement has been effected at right angles with the key blade. FIG. 6 shows a (very schematically represented) variant having a contact movement in the plane of the key. Every lug 2 is permitted to have its front edge acting on one end of a preferably resilient rib 14 which is mounted in a support plate 15 and in holes 17, corresponding to the lugs, in a guiding plate 16. When the key is inserted the lugs press the contact 4*a* of the corresponding rib 14 to engagement with the corresponding fixed contact point 4*b*.

Figure 7:
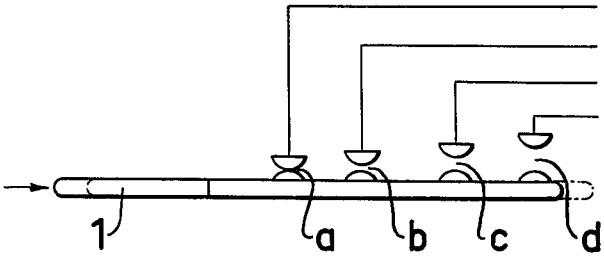
FIG. 7 shows a diagram of the consecutive contact closing when the key is inserted.

Finally, FIG. 7 shows the order of contact making and contact breaking, respectively, especially with cash registers. At (*a*) the initial position of the key 1 is shown (i.e. the key has been placed in position); (*b*) indicates a switching to the respective memory field; (*c*) provides a strobe pulse which senses all contact making and breaking functions; and (*d*) shows the end position of the key, for securing that the previous functions (*a*)-(*c*) actually have been completed.

Various modifications are possible within the scope of the invention. Thus, the contact members can be made in different ways—preferably plate springs. Particularly regarding the embodiment in FIG. 6 it should be observed that the contact ribs generally could be rigid, and that it is not necessary that the guiding plate is carried along by the key movement. Further, it is obvious that the insulations required can be made in different ways; as a simple example the diaphragm 11 in FIG. 4 may be of metal as long as the associated contacts 4*a* are insulated.

In all the four embodiments described above the key has both a register starting function, intended for the cash attendant, and an accessmaking to the electronic functions of the register, especially the memory. For avoiding an undue action on or disturbing of the electronic functions of the register, access to the electronic part is not made possible until a strobe pulse has been produced by a maximum insertion of the key. In normal cases one may count upon that all desired electronic functions can be filled by 16 data bits and a single strobe bit.

What is claimed is:

1. A lock system comprising:

a key having an edge portion along which there are formed a plurality of lugs and gaps in a predetermined pattern;

a key receiving means having an elongated passage for insertion of the key and longitudinal movement of the key along the passage;

a plurality of electrical contact members arrayed in first and second rows longitudinally along said passage, with the respective contact members of said first and second rows being opposite each other, and said contact members of said first row being fixedly mounted and said contact members of said second row being selectively movable toward and away from the contact members of said first row under control of the key;

a resilient return means adjacent said key passage for engagement by said key as it is moved longitudinally through said key passage, said key being movable to a rest position in said key passage where it is unbiased by said resilient means and said contact members of said second row are not moved, said key, when moved to a second position in said key passage engaging said return means and controlling corresponding contact members of said second row in accordance with the pattern of lugs and gaps on said key, to move said corresponding second row contact members toward and into electrical contact with said contact members of the first row.

2. A lock system according to claim 1 further comprising:

electrical contact means for establishing access to memory fields, said electrical contact means positioned within said key passage at a location between said rest position and said end position for engagement and operation by said key upon insertion of said key into said key passage.

3. A lock system in accordance with claim 2 further comprising:

second electrical contact means for producing a strobe pulse for allowing the making or breaking of said contact members to be sensed, said second electrical contact means being positioned within said key passage at a location between said end position and said rest position for engagement and operation by said key upon insertion of said key into said key passage.

4. A lock system according to claim 1 further comprising:

a key displacing means, located within said key passage, which, when said key is pushed into the key passage past the rest position, cooperates with the lugs of the key to cause them to press the corresponding movable contact members of said second row into engagement with or removal from said fixed contact members of said first row.

5. A lock system in accordance with claim 4 wherein said key displacing means comprises:

parallel link means, said means being pivotally mounted within said key passage for engaging said key upon insertion of said key into said key passage, said means pivoting when said key is pushed past said rest position for displacing said key so that the movable contact members opposite the corresponding lugs of said key are pushed against or away from the corresponding fixed contact members.

6. A lock system in accordance with claim 4 wherein said key displacing means comprises:

a plurality of inclined surfaces mounted in the key passage for engaging said key upon insertion and when said key is pushed past the rest position, displacing said key so that the movable contact members of the first row opposite the corresponding lugs of the key are pushed against or away from the corresponding fixed contact members.

7. A lock system in accordance with claim 4 wherein said key displacing means comprises:

an insulating plate slidably mounted in the key passage for allowing said insulating plate to be carried along with a translating movement of said key, said insulating plate having holes therein corresponding to the appropriate lugs of said key;

a support plate, fixedly mounted in the key passage above said insulating plate, said support plate having holes therein corresponding to the holes in said insulating plate and the appropriate lugs of said key, said movable contact members being resiliently mounted to the top of said support plate at positions corresponding to the holes therein; and a plurality of contact ribs, said contact ribs extending from said movable contact members and through the corresponding holes in said support plate and said insulating plate, and biased toward the edge of said key so that when said key is inserted into the key passage, past said rest position, said contact lugs are displaced by the lugs of said key to push said movable contact members against or away from said fixed contact members.

8. A lock system in accordance with claim 1 further comprising:

means for biasing said movable contact members toward a side surface of said key, so that when said key is inserted in said key passage, past said rest position, said movable contact members pass through the gaps of said key and are biased against or away from said fixed contact members.

9. A lock system in accordance with claim 8 wherein said biasing means comprises:

a plurality of spring loaded pins, movably mounted at one side of the key passage, said pins passing through the appropriate gaps in said key when said key is inserted into the key passage and moved past said rest position;

an elastic diaphragm, mounted at the opposite isde of said key passage between said pins and said movable contact members, said diaphragm being locally impressible by said pins to push said movable contact members against or away from said fixed contact members.

* * * * *